US007277110B2

(12) United States Patent
Zarem et al.

(10) Patent No.: US 7,277,110 B2
(45) Date of Patent: Oct. 2, 2007

(54) LASER-BASED THERMAL PRINTER

(75) Inventors: Harold A. Zarem, Palo Alto, CA (US); Omar S. Leung, Palo Alto, CA (US)

(73) Assignee: Silicon Light Machines Corporation, San Jose, CA (US)

( * ) Notice: Subject to any disclaimer, the term of this patent is extended or adjusted under 35 U.S.C. 154(b) by 113 days.

(21) Appl. No.: 11/084,669

(22) Filed: Mar. 18, 2005

(65) Prior Publication Data

US 2005/0212893 A1 Sep. 29, 2005

Related U.S. Application Data

(60) Provisional application No. 60/556,657, filed on Mar. 26, 2004.

(51) Int. Cl.
*B41J 2/38* (2006.01)

(52) U.S. Cl. ..... 347/185

(58) Field of Classification Search ..... 347/129, 347/133, 171, 185, 187, 207–208, 212, 224; 399/33

See application file for complete search history.

(56) References Cited

U.S. PATENT DOCUMENTS 4,994,852 A * 2/1991 Matsuuchi et al. ..... 399/33
5,550,571 A * 8/1996 Shoji ..... 347/133
6,431,685 B1 8/2002 Misumi
6,784,910 B2 8/2004 Sato et al.
6,819,348 B2 11/2004 Tamura et al.
6,822,665 B2 11/2004 Sugiyama et al.

* cited by examiner

*Primary Examiner*—K. Feggins
(74) *Attorney, Agent, or Firm*—Okamoto & Benedicto LLP

(57) ABSTRACT

One embodiment described pertains to a thermal printer is provided having a spatial light modulator (SLM) to modulate light from a laser source to record information on a thermal-sensitive surface of a recording medium, and a heater adjacent to the medium to preheat the thermal-sensitive surface prior to recording of information thereon. The printer may further include illumination optics for focusing the light beam onto the SLM, and imaging optics to image the light on the thermal-sensitive surface. The heater may comprise a resistive, a convective or a radiant heater. The printer may further include a feed mechanism with a roller having an outer surface in contact with the recording medium for feeding it past the imaging optics, and the heater may be disposed inside of the roller to heat the recording medium in contact with the roller. The heater may be arranged to heat the entire outer surface of the roller, or only a portion thereof. Other embodiments are also described.

12 Claims, 8 Drawing Sheets

500

600

LASER-BASED THERMAL PRINTER

REFERENCE TO RELATED APPLICATIONS

The present application claims the benefit of U.S. provisional application No. 60/556,657, entitled "Laser Photothermal Printer Using Heating to Improve Paper Sensitivity," filed Mar. 26, 2004, by inventors Harold Zarem and Omar S. Leung, the disclosure of which is hereby incorporated by reference.

TECHNICAL FIELD

The present invention relates generally to thermal printers.

BACKGROUND OF THE INVENTION

Thermal printers in which a thermal head scans in close contact with the surface of a heat-sensitive recording material or paper to record an image or other information thereon are widely known and used. The thermal head typically uses a resistive element as a heat source. Such systems are commonly employed in a facsimile, and in printers for registers, and other applications. However, close contact the thermal head and the heat-sensitive paper, can result in material being scraped from the paper by the thermal head. This material can attach to the thermal head separating it from the heat-sensitive paper, resulting in incomplete or incorrect recording of images. In addition, close contact between thermal head and the paper can result in the thermal head being damaged or destroyed.

Thermal printers in which a laser is used as a source of thermal energy and in which the thermal head is not brought into contact with the heat-sensitive paper have been proposed. However, conventional implementations of this approach have not been satisfactory for a number of reasons.

It is highly desirable to improve thermal printing technology. In particular, it is highly desirable to improve thermal printers in which a laser is used as a source of thermal energy.

SUMMARY OF THE INVENTION

One aspect of the present invention pertains to a thermal printer having a heater adjacent to a recording medium to preheat a thermal-sensitive surface of the recording medium prior to recording of information thereon. The thermal printing system further includes a laser source for generating a light beam, and an imaging system adapted to image the light beam on a portion the thermal-sensitive surface to record information thereon. Preferably, the recording medium is preheated to a temperature immediately or in a range below a predetermined temperature required to record information on the thermal-sensitive surface. The heater may comprise resistive heating elements, a convection heater or a radiant heater.

In one embodiment, the thermal printer further includes a feed mechanism with a roller having an outer surface in contact with the recording medium for feeding the recording medium past the imaging system, and the heater is disposed inside of the roller to heat the recording medium in contact with the roller. The heater may be positioned and oriented to heat substantially the entire outer surface of the roller, or such that only the portion that is in contact with the portion of the recording medium on which information is to be recorded is heated.

In another embodiment, the thermal printer further includes a temperature sensor and a controller to control the heater to maintain a heated portion of the outer surface of the roller at a substantially constant temperature.

In another aspect, the present invention is directed to a thermal printer including a spatial light modulator assembly to modulate a light beam from a laser source according to electric fields applied to control reflective components within the assembly. The thermal printer further includes illumination optics for focusing the light beam onto the spatial light modulator assembly, and imaging optics disposed in a light path between the spatial light modulator assembly and a thermal-sensitive surface of a recording medium to project or image the light beam on a portion of the thermal-sensitive surface to record information thereon. Preferably, the spatial light modulator assembly includes a linear array of diffractive MEMS (Micro Electromechanical Systems) elements, and each the diffractive MEMS element includes a number of deformable ribbons each having a light reflective planar surface. Optionally, the printer further includes a heater adjacent to the recording medium to preheat the thermal-sensitive surface prior to recording of information thereon.

BRIEF DESCRIPTION OF THE DRAWINGS

These and various other features and advantages of the present invention will be apparent upon reading of the following detailed description in conjunction with the accompanying drawings and the appended claims provided below, where:

DETAILED DESCRIPTION

Figure 1:
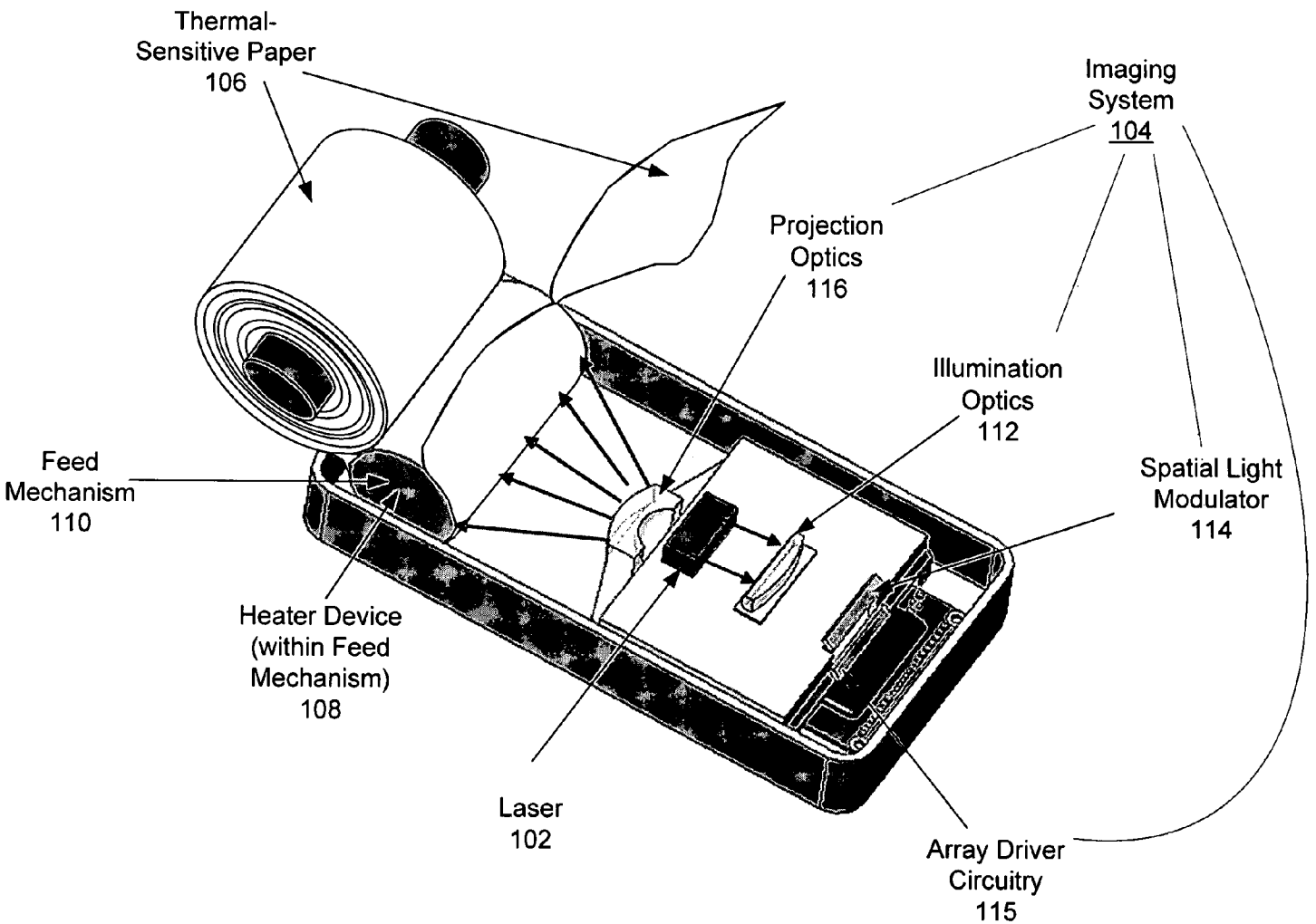
FIG. 1 is a perspective view of a thermal printer according to an embodiment of the present invention.

As discussed above, thermal printers have various problems and disadvantages. Using lasers as a heat source for thermal printing has been proposed, but conventional implementations of laser-based have various problems. These problems are now discussed.

One problem, is the relatively high threshold above which the heat-sensitive paper must be heated by the laser light in order to produce a change in color of the paper. This high threshold is required to provide a highly stable heat-sensitive paper having an adequate shelf life, and capable of being used in a wide range of environmental conditions. As a result the laser should preferably output a considerable amount of thermal energy to record an image on the paper. This high energy output requirement increases the size, complexity and cost of the laser thermal printer, and, in addition, can shorten laser life leading to higher operating costs.

Other problems with conventional laser-based thermal printers arise from the use of mechanical scanners to scan a laser spot onto the heat-sensitive papers. Typical laser-based thermal printers have scanning optics that include a laser for generating laser light, and a multifaceted mirror or scanner that spins at high speed for scanning laser light.

There are several evident limitations associated with this approach. Scanners require a predetermined time to spin up to operating speed prior to printing a first page, and the spinning speed inherently limits how fast the scanner can scan. The mechanical nature of this scanning mechanism is thus disadvantageous and also leads to increased operating noise and maintenance costs.

Additionally, while conventional scanning optics can be satisfactorily used in a wide variety of printing applications, there are emerging applications that require even higher pixel resolutions than can be provided by the architecture described above. Lastly, a conventional single spot system requires rapid modulation of the laser beam, which is not necessarily easy to achieve with a high power laser.

Accordingly, there is a need for a laser-based thermal printer that is capable of using a lower laser output power, and has an architecture that is simple and cost-effective. There is a further need for a laser thermal or photothermal printer that exhibits a high printing speed.

Embodiments of the present invention relate to thermal printers, and more particularly to laser-based thermal printers having spatial light modulators (SLMs) and a pre-heater for pre-heating a heat-sensitive substrate or paper.

In laser thermal printing, a laser beam is projected or imaged onto a heat or thermal-sensitive recording medium, such as thermal paper. Exposure to the laser causes development of color or pigment in very fine heat-sensitive bodies arranged on a thermal-sensitive surface of the thermal paper to produce the desired letters or image. In accordance with an embodiment of the invention, the recording medium is advantageously pre-heated by a resistive, radiant, or convective heater prior to the exposure to the laser beam.

In laser photothermal printing, an area of the photo-sensitive surface of the recording medium may be heated by exposure to a first laser light in order to become sensitive or susceptible to be written or recorded upon by a second laser light from the same or a separate laser. Alternatively, the recording medium may be a heat-developable medium in which the photo-sensitive surface is heated by the laser light to develop the information previously written or recorded thereon by light from the same or a separate laser or from another light source. In accordance with an embodiment of the invention, the recording medium is advantageously heated by a resistive, radiant, or convective heater prior to or after exposure to a laser writing beam.

Referring to FIG. 1, a laser-based thermal printer according to an embodiment of the present invention includes a laser source 102 to generate a light beam, an imaging system 104 to image or project the light beam onto the thermal-sensitive surface of a portion of the thermal paper 106, and a heater device 108 adjacent to the paper to preheat the thermal-sensitive surface prior to recording of information thereon. Each of the above elements of the thermal printer will now be described in greater detail.

The heater 108 comprises a non-laser device and may include resistive, convective or radiant heating elements. Preferably, the heater 108 is adapted to preheat the thermal-sensitive surface of the paper 106 to a predetermined temperature immediately or in a range below a predetermined temperature required to record information on the thermal-sensitive surface. More preferably, the heater 108 is adapted to put out from about 20 to about 80 Watts (W) to preheat the thermal-sensitive surface to a temperature of from about 40 C. to about 70 C.

In the embodiment shown, the printer further includes a feed mechanism 110 comprising a roller having an outer surface in contact with the thermal paper 106 for feeding it past the imaging system, and the heater 108 is disposed inside of the roller to heat the recording medium in contact with the roller. The heater 108 can be positioned and oriented to heat substantially the entire outer surface of the roller, or such that only the portion that is in contact with the portion of the recording medium on which information is to be recorded is heated.

Figure 2B:
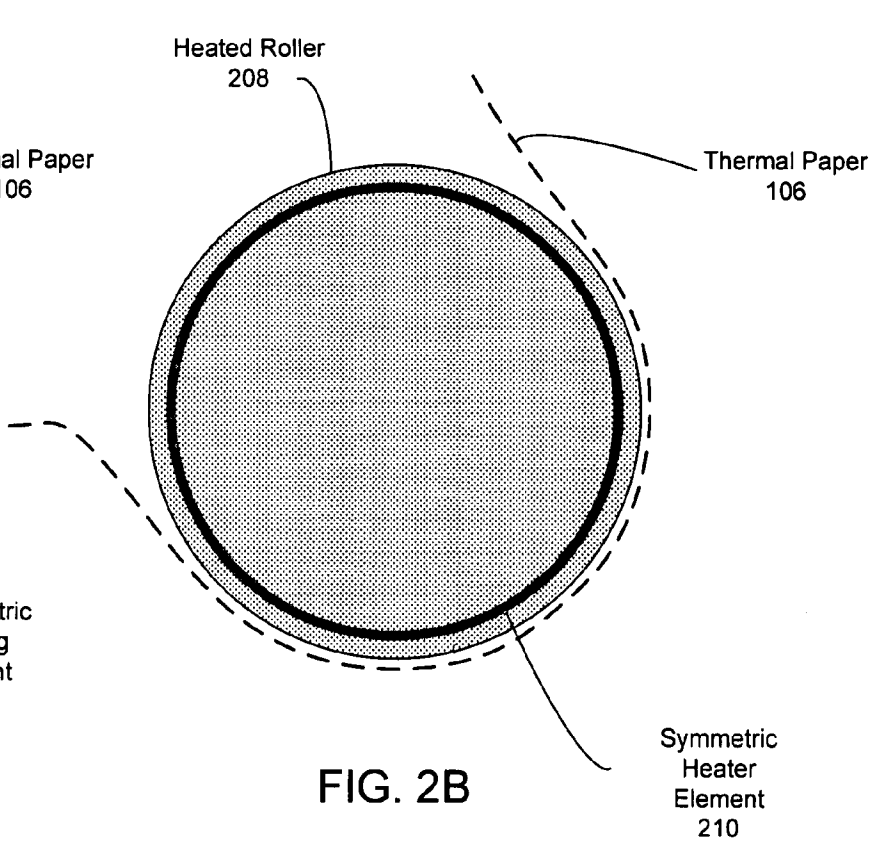
FIGS. 2A through 2D are cross-sectional diagrams of various heating devices in accordance with embodiments of the present invention.
Figure 2A:
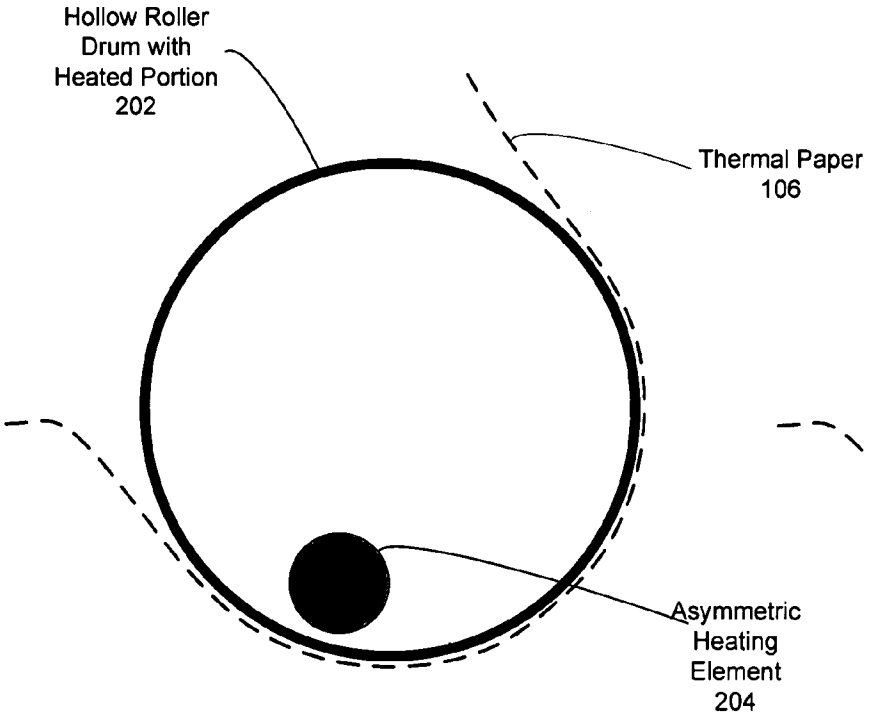

For example, in one embodiment, shown in FIG. 2A, the heated roller 202 may be a thin, hollow cylinder, and the heater may comprise an asymmetric heater element 204. The asymmetric heater element 204 may comprise, for example, a rod-shaped heating element 204 located or positioned in an asymmetric manner near or in contact with the inner surface of the cylindrical roller 202.

In another embodiment, an example of which is shown in FIG. 2B, the heated roller 208 may include a symmetric heater element 210. The symmetric heater element 210 may be configured (for example, as a cylinder within the roller 208) so that substantially the whole outer surface of the roller 208 is heated.

Figure 2D:
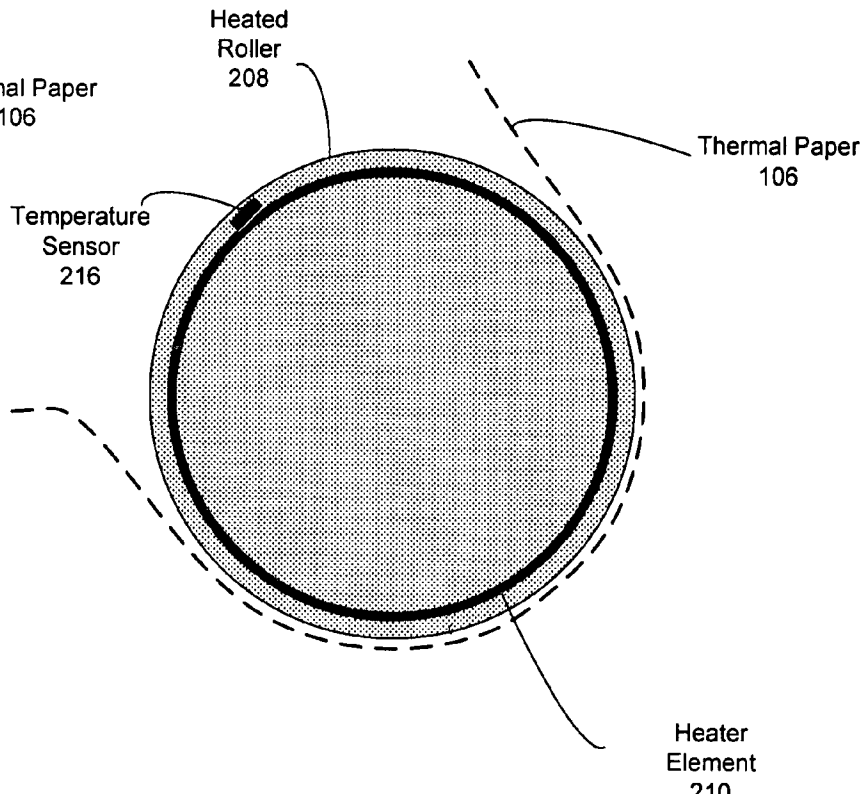
Figure 2C:
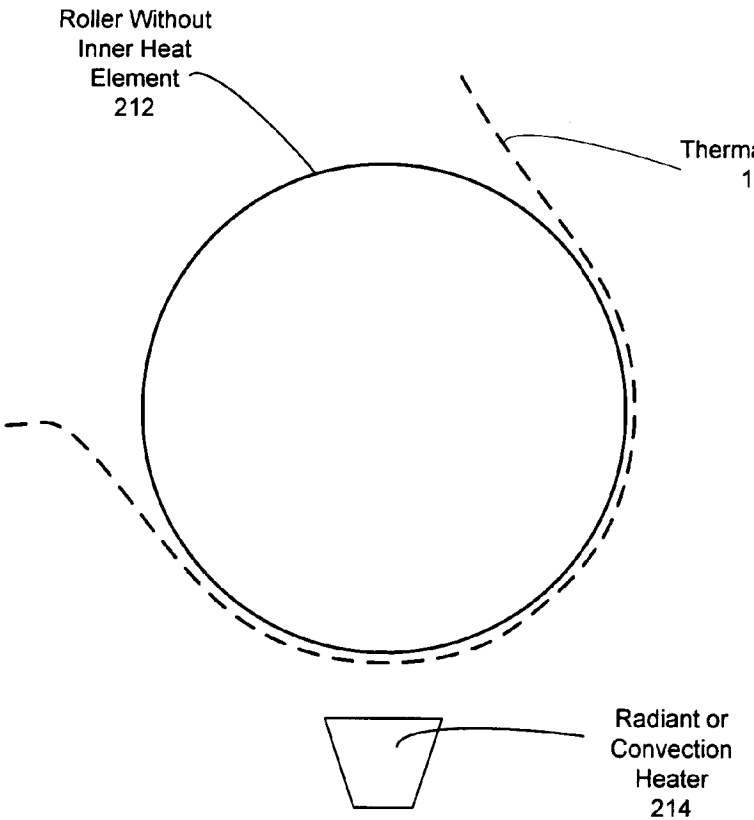

In another embodiment, an example of which is shown in FIG. 2C, the heater 108 comprises a radiant heater 214 positioned and oriented to direct thermal radiation directly on the thermal-sensitive surface of the thermal paper 106. In such an embodiment, the roller 212 itself need not incorporate an inner heat element.

In yet another embodiment, an example of which is shown in FIG. 2D, the thermal printer further includes a temperature sensor 216 and a controller (for example, the controller 302 shown in FIG. 3) to control the heater element 210 to maintain the heated portion of the outer surface of the roller 208 at a substantially constant temperature. Although the temperature sensor 216 is shown in FIG. 2D in conjunction with the heated roller 208 of FIG. 2D, the temperature sensor 216 may also be utilized with other embodiments.

The laser source 102 may comprise a number of lasers or laser emitters, such as diode lasers, each powered from a common power supply (not shown) in a CW (Continuous Wave) operation. Preferably, the laser source is a high-power diode laser producing from about 5000 to about 40,000 mW of power at a wavelength of from about 750 to about 1000 nm.

The imaging system 104 may comprise illumination optics 112 that receives and directs the light from the laser source 102, a spatial light modulator (SLM) 114 that modulates light the laser light according to or under the influence of an applied electric field applied thereto, and projection optics 116 to project the modulated light onto the thermal-sensitive surface of a portion of the thermal paper 106 to record information thereon. For purposes of clarity, many of the details of SLM 114 that are widely known and are not relevant to the present invention have been omitted from the following description. In one embodiment the SLM includes one or more ribbon light modulators, such as a Grating Light Valve™ (GLV®) commercially available from Silicon Light Machines Corporation of Sunnyvale, Calif. Ribbon light modulators are described in more detail in, for example, in U.S. Pat. No. 5,311,360 to Bloom et al.; and U.S. Pat. No. 5,661,592 to Bornstein et al. Generally, a ribbon light modulator includes a number of ribbons each having a light reflective surface supported over a reflective surface of a substrate. Each ribbon may be deflectable toward the substrate to form an addressable diffraction grating with adjustable diffraction strength. The ribbons may be electro-statically deflected towards or away from the substrate by integrated drive electronics formed in or on the surface of the substrate.

Figure 3:
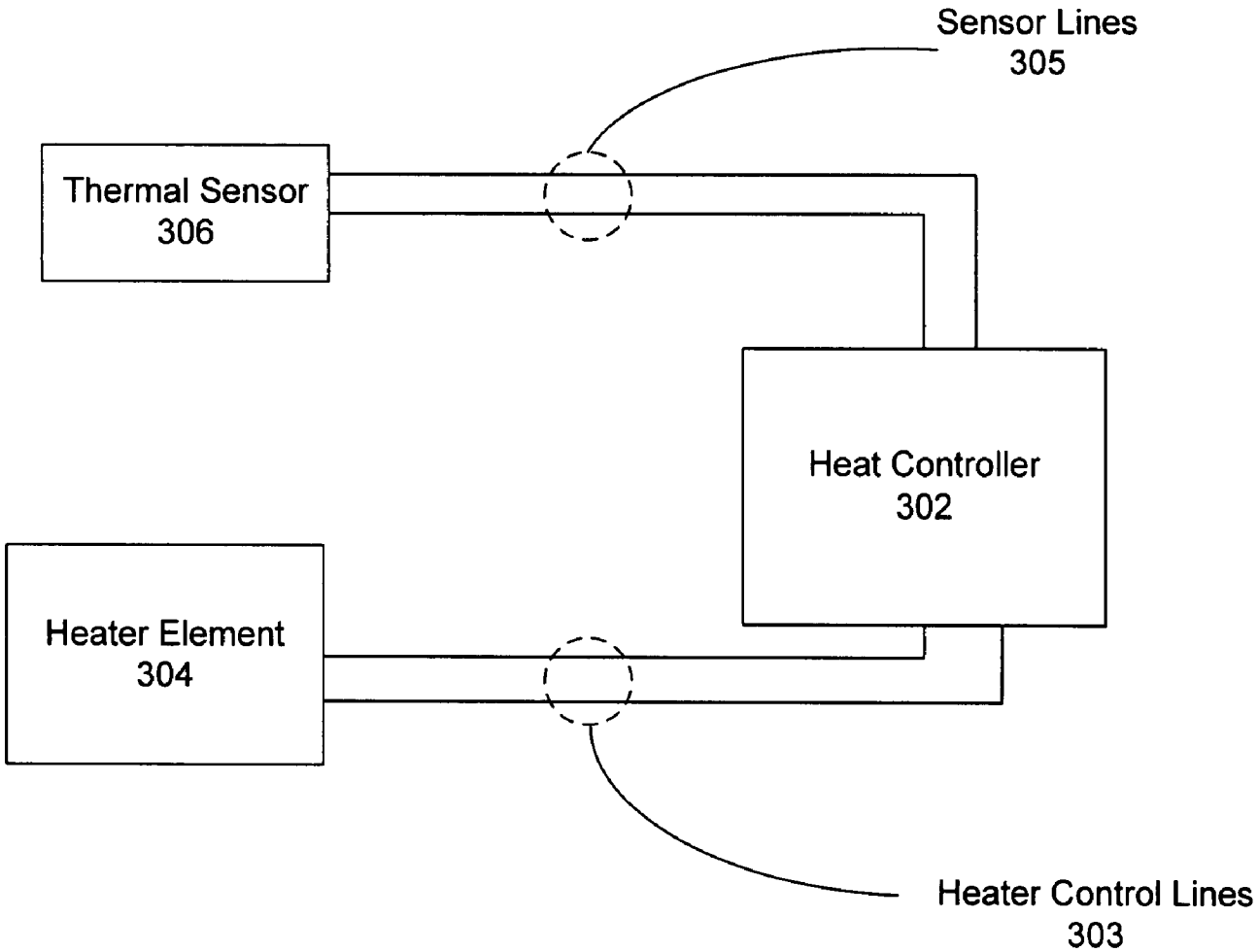
FIG. 3 is a block diagram of a heater control system in accordance with an embodiment of the invention.

FIG. 3 is a block diagram of a heater control system in accordance with an embodiment of the invention. The heater control system comprises a heat controller 302 which may be a microcontroller or similar device. The heat controller 302 may be connected via heater control lines 303 to a heater element 304. By controlling the signals (for example, the electrical current) on the control lines 303, the amount of heat output by the heater element 304 may be controlled or adjusted.

The heat controller 302 may also be connected via sensor lines 305 to a thermal sensor 306. The thermal sensor 306 being placed so as to read a temperature associated with the heater device 108 or a temperature associated with the thermal-sensitive paper 106. A control feedback loop may be formed where the controller 302 utilizes the feedback from the sensor 306 to control the heater element 304.

Figure 4:
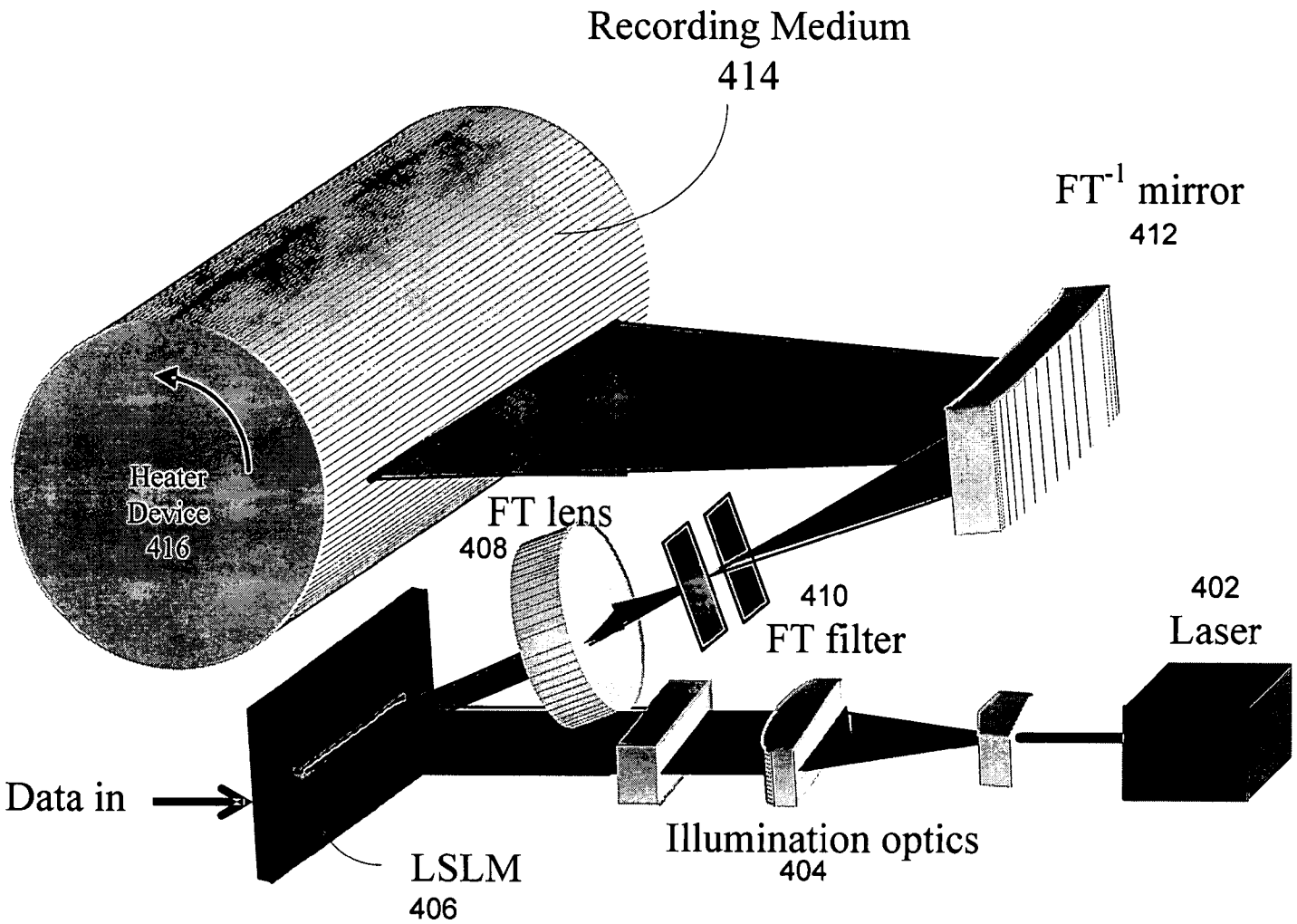
FIG. 4 is a schematic diagram of a layout for a thermal printer having a heater device and a spatial light modulator assembly according an embodiment of the present invention.

In a preferred embodiment of the imaging system, shown in FIG. 4, the imaging system comprises a linear diffractive spatial light modulator (LSLM) 406 and optics to expand the light beam and impinge the light beam simultaneously on a substantially linear portion of the thermal-sensitive surface of the recording medium 414. Generally, the LSLM 406 includes a linear array of a number of individual diffractive MEMS elements or diffractors (not shown in this figure). The diffractive MEMS elements may be grouped or functionally linked to provide a number of pixels. Preferably, the LSLM 406 has a pixel count adequate to cover a swath extending substantially across the entire width of the thermal-sensitive surface of the thermal paper. More preferably, the LSLM 406 has a pixel count of at least about five hundred pixels, and most preferably of at least about one thousand pixels. For example, in one version of the layout illustrated in FIG. 4, the LSLM 406 may have sufficient number of pixels to cover an entire eight inch (8") swath on thermal paper used in a standard facsimile thermal printer with two thousand dots-per-inch (2000 dpi) printing resolution.

In the architecture shown in FIG. 4, the imaging system further includes illumination optics 404 to focus light beam from the laser source on the LSLM 406, and imaging optics having magnification and filtering elements to direct an image from the LSLM 406 onto thermal-sensitive surface of the recording medium 414.

In the embodiment shown, the illumination optics 404 includes a number of elements including lens integrators, mirrors and prisms, designed to transfer light from the laser source 402 to the LSLM 406 such that a line of a specified size is illuminated at the LSLM 406. In particular, the illumination optics 404 may be adapted to illuminate a swath covering substantially the full width of the LSLM 406.

The imaging optics may include magnification elements, such as a FT (Fourier Transform) lens 408 and a $FT^{-1}$ mirror 412, and filter elements, such as a FT filter 410, designed to transfer light from the LSLM 406 to the recording medium 414 such that the thermal-sensitive surface is illuminated across a swath covering substantially the full width of the recording medium 414.

Figure 5:
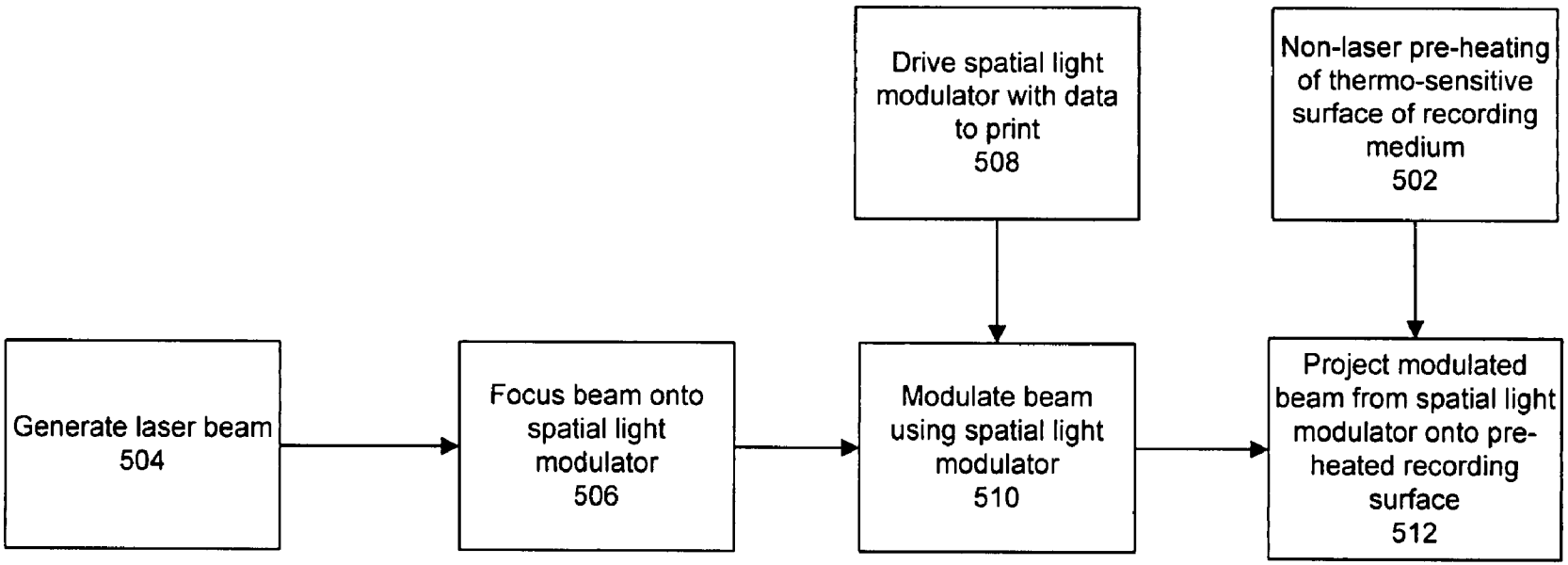
FIG. 5 is a flow chart of a method of laser thermal or photothermal printing with non-laser pre-heating in accordance with an embodiment of the present invention.

A method or process 500 for thermally recording information on a thermo-sensitive surface of a thermal paper according to an embodiment of the present invention will now be described. As shown in FIG. 5, the method may include the steps of: (i) non-laser pre-heating 502 the thermo-sensitive surface of the recording medium; (ii) generating 504 a light beam from a laser source; (iii) focusing 506 the light beam onto a spatial light modulator assembly; (iv) driving 508 the spatial light modulator with data to be printed; (v) modulating 510 the light beam reflected from the spatial light modulator assembly in accordance with an electric field applied thereto; and (vi) projecting 512 the light beam reflected from the spatial light modulator onto a pre-heated portion of the thermal-sensitive surface to record information thereon. Preferably, the step of pre-heating 502 the thermo-sensitive surface of the recording medium involves pre-heating the thermo-sensitive surface to a temperature or temperature range immediately below a temperature required to record information on the thermal-sensitive surface. The pre-heating 502 may be performed, for example, by using a resistive heating element, or by using radiant or convection heating.

Figure 6:
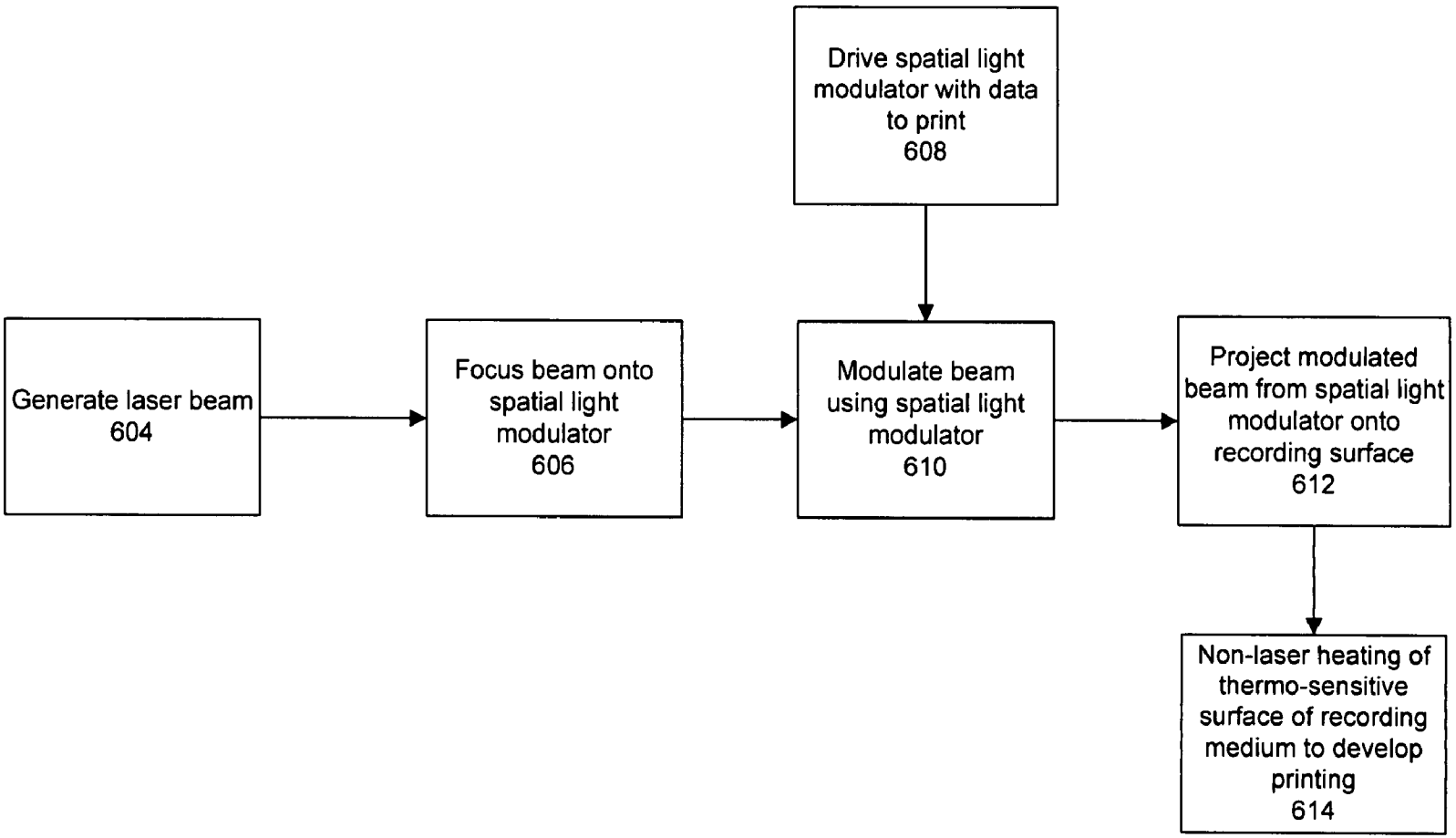
FIG. 6 is a flow chart of a method of laser photothermal printing with non-laser heating to develop the recorded information in accordance with an embodiment of the present invention.

FIG. 6 is a flow chart of a method of laser photothermal printing in accordance with an embodiment of the present invention. As shown in FIG. 6, the method may include the steps of: (i) generating 604 a light beam from a laser source; (ii) focusing 606 the light beam onto a spatial light modulator assembly; (iii) driving 608 the spatial light modulator with data to be printed; (iv) modulating 610 the light beam reflected from the spatial light modulator assembly in accordance with an electric field applied thereto; (v) projecting 612 the light beam reflected from the spatial light modulator onto a portion of the photo-sensitive surface to record information thereon; and (vi) non-laser heating 614 the photo-sensitive surface of the recording medium to a predetermined temperature or temperature range to develop the recorded information. The heating 614 may be performed, for example, by using a resistive heating element, or by using radiant or convection heating.

Figure 7A:
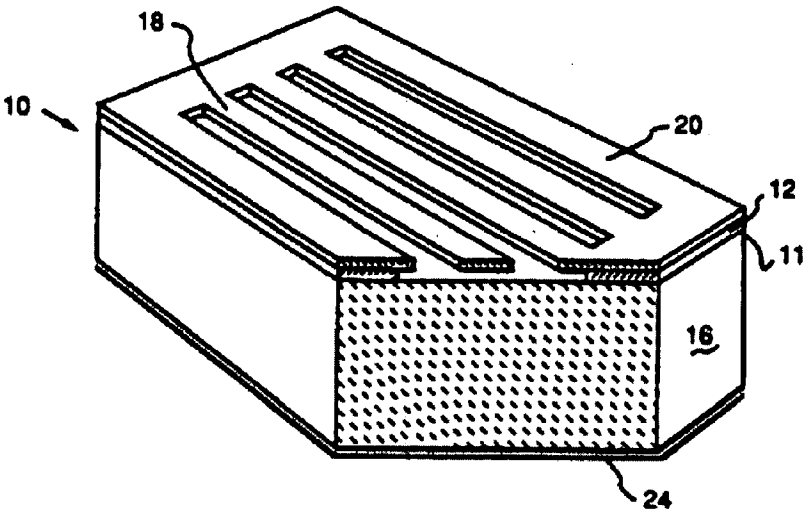
FIGS. 7A and 7B depict, respectively, an example diffractive MEMS element and a linear array of diffractive MEMS elements in accordance with an embodiment of the invention.
Figure 7B:
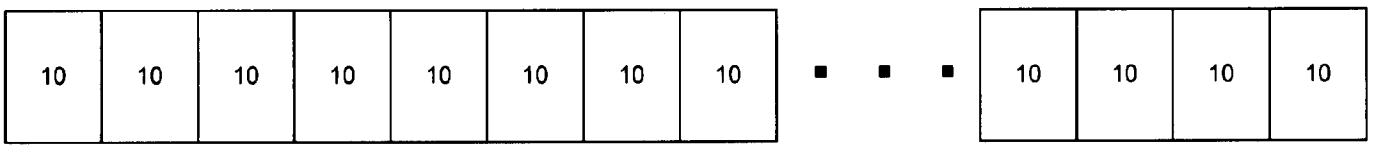

FIG. 7A depicts an example diffractive MEMS element 10. In FIG. 7A, the elongated elements (deformable ribbons) 18 together with the frame 20 define a grating which, as further explained in U.S. Pat. No. 5,311,360, can be used for modulating a light beam. As depicted in FIG. 7A, the example diffractive MEMS element 10 also includes a silicon substrate 16, an insulating layer 11, a silicon dioxide film 12, and an aluminum film 24. FIG. 7B depicts a linear array of diffractive MEMS elements 10 in accordance with an embodiment of the invention.

What is claimed is:

1. A thermal printer comprising:

a laser source to generate a light beam;

an imaging system adapted to image the light beam on a thermal-sensitive surface of a portion of a recording medium to record information thereon, the imaging system including a spatial light modulator to modulate light from the laser source; and a heater adjacent to the recording medium to preheat the thermal-sensitive surface prior to recording of information thereon, the heater adapted to preheat the thermal-sensitive surface to a temperature below a predetermined temperature required to record information on the thermal-sensitive surface, wherein the spatial light modulator comprises a linear array of diffractive MEMS elements, and wherein each the diffractive MEMS elements comprises a plurality of deformable ribbons having a light reflective planar surface.

2. The thermal printer according to claim 1, further comprising a feed mechanism including a roller having an outer surface in contact with the recording medium for feeding the recording medium past the imaging system, and wherein the heater is disposed inside of the roller to heat the recording medium in contact therewith through the outer surface thereof.

3. The thermal printer according to claim 2, wherein the heater is positioned and oriented to heat only a portion of the outer surface of the roller that is in contact with the portion of the recording medium on which information is to be recorded.

4. The thermal printer according to claim 2, wherein the heater is positioned and oriented to heat substantially the entire outer surface of the roller.

5. The thermal printer according to claim 4, further comprising:

a temperature sensor; and a controller to control the heater to maintain the outer surface of the roller at a substantially constant temperature.

6. The thermal printer according to claim 1, wherein the heater is selected from the group consisting of:

resistive heating elements;

convection heaters; and radiant heaters.

7. The thermal printer according to claim 1, wherein the heater comprises a radiant heater positioned and oriented to direct thermal radiation directly on the thermal-sensitive surface of the recording medium.

8. The thermal printer according to claim 1, wherein the thermal-sensitive surface is preheated to a temperature within a range from 40 degrees Celsius to 70 degrees Celsius.

9. A thermal printing system comprising a laser source to generate a light beam;

a spatial light modulator assembly to modulate light from the laser source according to electric fields applied to control reflective components within the assembly;

illumination optics configured to focus the light beam onto the spatial light modulator assembly; and imaging optics disposed in a light path between the spatial light modulator assembly and a thermal-sensitive surface of a recording medium to image the light beam on a portion of the thermal-sensitive surface to record information thereon, wherein the spatial light modulator assembly comprises a linear array of diffractive MEMS elements, and wherein each the diffractive MEMS elements comprises a plurality of deformable ribbons having a light reflective planar surface.

10. The thermal printing system according to claim 9, further comprising a heater adjacent to the recording medium to preheat the thermal-sensitive surface prior to recording of information thereon, the heater adapted to preheat the thermal-sensitive surface to a temperature below a predetermined temperature required to record information on the thermal-sensitive surface.

11. A method of thermally recording information on a thermo-sensitive surface of a recording medium, the method including steps of:

pre-heating the thermo-sensitive surface of the recording medium;

generating a light beam from a laser source;

focusing the light beam onto a spatial light modulator assembly;

modulating the light beam reflected from the spatial light modulator assembly in accordance with an electric field applied thereto; and projecting the light beam reflected from the spatial light modulator onto a portion of the thermal-sensitive surface to record information thereon, wherein the spatial light modulator assembly comprises a linear array of diffractive MEMS elements, and wherein each the diffractive MEMS elements comprises a plurality of deformable ribbons having a light reflective planar surface.

12. The method according to claim 11, wherein the thermo-sensitive surface of the recording medium is preheated to a temperature below a predetermined temperature required to record information on the thermal-sensitive surface.

* * * * *